US010737307B2

(12) United States Patent
Sumikawa et al.

(10) Patent No.: US 10,737,307 B2
(45) Date of Patent: Aug. 11, 2020

(54) PRESS FORMING METHOD AND PRESS FORMING TOOL

(71) Applicant: JFE STEEL CORPORATION, Tokyo (JP)

(72) Inventors: Satoshi Sumikawa, Tokyo (JP); Masaki Urabe, Tokyo (JP); Jiro Hiramoto, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 526 days.

(21) Appl. No.: 15/551,136

(22) PCT Filed: Feb. 3, 2016

(86) PCT No.: PCT/JP2016/053207
§ 371 (c)(1),
(2) Date: Aug. 15, 2017

(87) PCT Pub. No.: WO2016/132905
PCT Pub. Date: Aug. 25, 2016

(65) Prior Publication Data

US 2018/0065164 A1 Mar. 8, 2018

(30) Foreign Application Priority Data

Feb. 17, 2015 (JP) ..... 2015-028338

(51) Int. Cl.
*B21D 22/26* (2006.01)
*B21D 5/01* (2006.01)
(Continued)

(52) U.S. Cl.
CPC ..... *B21D 22/26* (2013.01); *B21D 5/00* (2013.01); *B21D 5/006* (2013.01); *B21D 5/01* (2013.01);
(Continued)

(58) Field of Classification Search
CPC ..... B21D 22/26; B21D 22/02; B21D 22/21; B21D 24/00; B21D 24/005; B21D 22/30;
(Continued)

(56) References Cited

U.S. PATENT DOCUMENTS 8,776,570 B2 7/2014 Maeda et al.
9,718,113 B2 8/2017 Nakata et al.
(Continued)

FOREIGN PATENT DOCUMENTS

CN 102764807 A 11/2012
CN 104136142 A 11/2014
(Continued)

OTHER PUBLICATIONS

Chinese Office Action for Chinese Application No. 201680010531.6, dated Jul. 23, 2018 with Concise Statement of Relevance of Office Action, 6 pages.
(Continued)

*Primary Examiner* — Teresa M Ekiert
(74) *Attorney, Agent, or Firm* — RatnerPrestia

(57) ABSTRACT

A press forming method according to the present invention includes: a first forming step of forming the press formed part by using the first press forming tool having a line length in the cross-sectional direction of the joining portion contacting with a flange portion subjected to stretch flange deformation or a flange portion subjected to shrink flange deformation is a line length $L_1$ in the cross-sectional direction that is shorter than a line length $L_2$, where the line length $L_2$ is a line length in a cross-sectional direction of the joining portion of the second press forming tool for making the product shape; and a second forming step of forming the press formed part in the product shape by crash forming by using the second press forming tool in which the line length in the cross-sectional direction of the joining portion is $L_2$.

9 Claims, 15 Drawing Sheets

(51) Int. Cl.

| | |
|---|---|
| ***B21D 24/00*** | (2006.01) |
| ***B21D 22/02*** | (2006.01) |
| ***B21D 22/21*** | (2006.01) |
| ***B21D 5/00*** | (2006.01) |

(52) U.S. Cl.
CPC ..... *B21D 22/02* (2013.01); *B21D 22/21* (2013.01); *B21D 24/00* (2013.01)

(58) Field of Classification Search
CPC ..... B21D 5/01; B21D 5/006; B21D 53/88; B21D 31/005
See application file for complete search history.

(56) References Cited

U.S. PATENT DOCUMENTS

| | | | |
|---|---|---|---|
| 2012/0279273 | A1 | 11/2012 | Tsuchiya et al. |
| 2014/0356643 | A1 | 12/2014 | Nakata et al. |
| 2015/0367397 | A1 | 12/2015 | Uchiyama et al. |
| 2016/0121384 | A1 | 5/2016 | Sumikawa et al. |
| 2018/0009017 | A1* | 1/2018 | Otsuka ..... B21D 5/01 |

FOREIGN PATENT DOCUMENTS

| | | | |
|---|---|---|---|
| JP | 2007190588 | A | 8/2007 |
| JP | 4766084 | B2 | 9/2011 |
| JP | 2012051005 | A | 3/2012 |
| JP | 5382281 | B1 | 1/2014 |
| WO | 2014208181 | A1 | 12/2014 |
| WO | 2013094705 | A1 | 4/2015 |

OTHER PUBLICATIONS

International Search Report and Written Opinion for International Application No. PCT/JP2016/053207, dated May 10, 2016—4 Pages.

* cited by examiner (a)

(b)

(a)

(b)

PRESS FORMING METHOD AND PRESS FORMING TOOL

CROSS REFERENCE TO RELATED APPLICATIONS

This is the U.S. National Phase application of PCT International Application No. PCT/JP2016/053207, filed Feb. 3, 2016, and claims priority to Japanese Patent Application No. 2015-028338, filed Feb. 17, 2015, the disclosures of each of these applications being incorporated herein by reference in their entireties for all purposes.

FIELD OF THE INVENTION

The present invention relates to a press forming method and a press forming tool for forming a press formed part having a product shape including a groove-shaped portion extending in a longitudinal direction and a flange portion curved along the longitudinal direction on at least one of a pair of side wall portions defining the groove-shaped portion.

BACKGROUND OF THE INVENTION

Press forming is a method of processing a material blank by pressing a press forming tool against the material blank to be processed to transfer the shape of the press forming tool to the target material blank. This press forming often causes the problem that, after the press formed part is extracted from the press forming tool, a defective shape, so-called springback occurs due to elastic recovery of residual stress in the press formed part, and the press formed part has a shape different from a desired shape.

A degree of springback is largely influenced mainly by strength of a material. In recent years, especially in the automobile industry, a high-strength steel sheet has been increasingly used for automotive parts in view of weight reduction of automotive body. However, the degree of springback is increased as the strength of the material is increased. Thus, to make the shape after springback closer to a designed shape, a skilled person needs to correct the press forming tool several times at a production site and to repeat trial and error. As a result, a production period is prolonged. Thus, reduction of springback is an increasingly important object to reduce the production period and the cost of automobiles.

To reduce springback, residual stress which causes springback needs to be controlled. As a technique of reducing springback by controlling residual stress, a technique disclosed in Patent Literature 1 is known. This technique relates to press forming for a hat-shaped cross section having a punch bottom portion, a side wall portion, and a flange portion. In this technique, a bending radius of curvature is reduced or a formed height is increased at a pre-process of final press forming process at a portion where tensile stress is generated on an edge line from the punch bottom portion to the side wall portion to cause a line length of the hat-shaped cross section at the pre-process to be longer than a line length of a final hat-shaped cross section, and then cause the hat-shaped cross section to be formed into a product shape in the final process, whereby compressive strain is applied in a hat-shaped cross section direction to reduce the tensile stress. Moreover, in this technique, the bending radius of curvature is increased or the formed height is reduced at the pre-process of the final press forming process at a portion where compressive stress is generated in the hat-shaped cross section direction to cause the line length of the hat-shaped cross section at the pre-process to be shorter than the line length of the final hat-shaped cross section, and then cause the hat-shaped cross section to be formed into the product shape in the final process, whereby tensile strain is applied in the hat-shaped cross section direction to reduce the compressive stress.

Additionally, Patent Literature 2 discloses a technique of providing the effect of reducing springback due to angle variation by preliminary bending a bending portion of a punch shoulder portion in the first process, and forming the bending portion with a press forming tool in which the corresponding portion is chamfered in the second process.

PATENT LITERATURE

Patent Literature 1: Japanese Laid-open Patent Publication No. 2007-190588

Patent Literature 2: Japanese Patent No. 4766084

SUMMARY OF THE INVENTION

In the technique disclosed in Patent Literature 1 described above, the line length of the hat-shaped cross section is forcibly changed by being formed with a plurality of press forming tools having different dimensions to prevent springback such as angle variation of the bending portion of the hat-shaped cross section or curl of the side wall portion. The technique disclosed in Patent Literature 2 prevents springback that is caused when an angle of a bending portion of a cross section is changed with angle variation of the bending portion of the cross section of a part.

The technique disclosed in Patent Literatures 1 and 2 prevents springback generated in segment of a (two-dimensional) cross section of a formed part such as angle variation of the bending portion and curl of the side wall portion. However, in an actual part, springback such as torsion or bending that is three-dimensionally generated on the entire part often is a problem. The technique disclosed in Patent Literatures 1 and 2 cannot solve such a problem. There is also a problem in the technique disclosed in Patent Literatures 1 and 2 in that a wrinkle or a fracture is easily generated because the line length of segment of the formed part is changed.

The present invention has been made in view of such a situation, and provides a press forming method and a press forming tool for reducing three-dimensional springback such as torsion or bending generated in the entire part.

To solve the problem and achieve the object, a press forming method according to an aspect of the present invention for forming a press formed part having a product shape that has a groove-shaped portion extending in a longitudinal direction and includes a flange portion curved along the longitudinal direction on at least one of a pair of side wall portions defining the groove-shaped portion, using a first press forming tool and a second press forming tool each including a side wall forming portion, a flange forming portion, and a joining portion that joins the flange forming portion to the side wall forming portion. The press forming method includes: a first forming step of forming the press formed part by using the first press forming tool having a line length in the cross-sectional direction of the joining portion contacting with a flange portion subjected to stretch flange deformation or a flange portion subjected to shrink flange deformation is a line length $L_1$ in the cross-sectional direction that is shorter than a line length $L_2$, where the line length $L_2$ is a line length in a cross-sectional direction of the joining portion of the second press forming tool for making the product shape, in order to make a line length of the flange portion subjected to stretch flange deformation in a longitudinal direction longer than a line length of the flange portion of the product shape and to make a line length of the flange portion subjected to shrink flange deformation in the longitudinal direction shorter than the line length of the flange portion of the product shape; and a second forming step of forming the press formed part in the product shape by crash forming by using the second press forming tool in which the line length in the cross-sectional direction of the joining portion is $L_2$.

Moreover, in the press forming method according to an embodiment of the present invention, the first forming process and the second forming process are applied to one of the pair of side wall portions.

Moreover, in the press forming method according to an embodiment of the present invention, the first forming process and the second forming process are applied to both of the pair of side wall portions.

Moreover, in the press forming method according to an embodiment of the present invention, in a case of forming a press formed part including a punch bottom portion, the first forming process and the second forming process are performed with a portion of a blank corresponding to the punch bottom portion pressed with a pad.

Moreover, in the press forming method according to an embodiment of the present invention, the joining portions of the first press forming tool and the second press forming tool have an arc cross-sectional shape.

Moreover, in the press forming method according to an embodiment of the present invention, the joining portion of the first press forming tool has an arc cross-sectional shape, and the joining portion of the second press forming tool has a chamfered cross-sectional shape produced by chamfering the arc shape.

Moreover, a press forming tool according to an embodiment of the present invention used for a press forming method for forming a press formed part having a product shape that has a groove-shaped portion extending in a longitudinal direction and includes a flange portion that is curved along the longitudinal direction on at least one of a pair of side wall portions defining the groove-shaped portion and subjected to stretch flange deformation and/or shrink flange deformation, through a first forming process and a second forming process, the press forming tool includes: a first press forming tool for the first forming process and a second press forming tool for the second forming process, wherein the first press forming tool and the second press forming tool each include a side wall forming portion, a flange forming portion, and a joining portion that joins the flange forming portion to the side wall forming portion, and a line length in a cross-sectional direction of the joining portion of the first press forming tool is set to be shorter than a line length in a cross-sectional direction of the joining portion of the second press forming tool, the joining portion of the first press forming tool being in contact with a flange portion subjected to stretch flange deformation or a flange portion subjected to shrink flange deformation in the first press forming tool.

Moreover, in the press forming tool according to an embodiment of the present invention, the joining portions of the first press forming tool and the second press forming tool have an arc cross-sectional shape.

Moreover, in the press forming tool according to an embodiment of the present invention, the joining portion of the first press forming tool has an arc cross-sectional shape, and the joining portion of the second press forming tool has a chamfered cross-sectional shape produced by chamfering the arc shape.

The present invention can reduce three-dimensional springback such as torsion or bending generated in the entire part.

DETAILED DESCRIPTION OF EMBODIMENTS OF THE INVENTION

Figure 18:
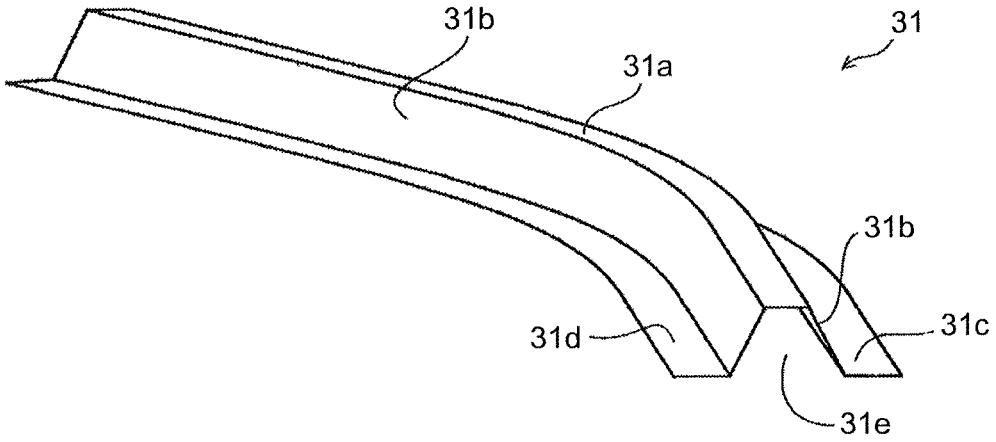
FIG. 18 is a diagram for explaining a problem of the present invention, and is a perspective view illustrating an example of a product shape of a press formed part as a target of the present invention.
Figure 19:
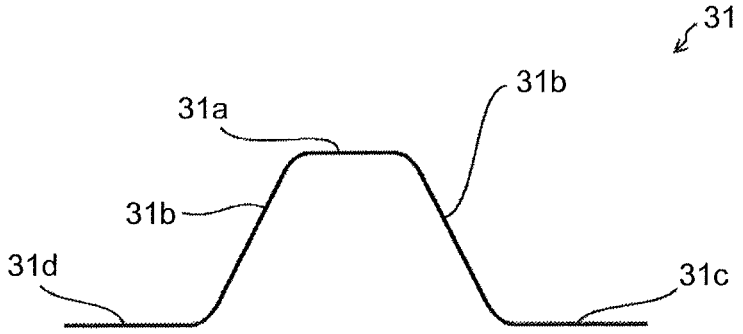
FIG. 19 is a cross-sectional view of a product illustrated in FIG. 18.

To solve the above problem, the inventors of the present invention have examined a form of springback generated in a press formed part 31 when the press formed part 31 is crash-formed, the press formed part 31 including a groove-shaped portion 31*e* that includes a punch bottom portion 31*a* and a side wall portion 31*b*, and a flange that is formed with flange portions (an outer flange 31*c* and an inner flange 31*d*) and curved along a longitudinal direction as illustrated in FIGS. 18 and 19.

Figure 20:
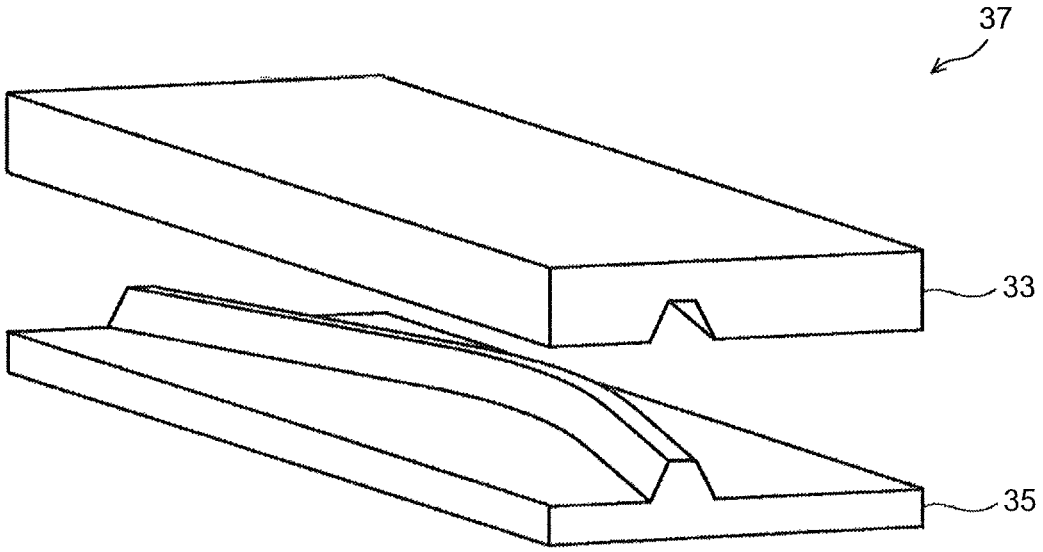
FIG. 20 is a diagram illustrating an example of a press forming tool for forming the press formed part illustrated in FIG. 18.
Figure 21:
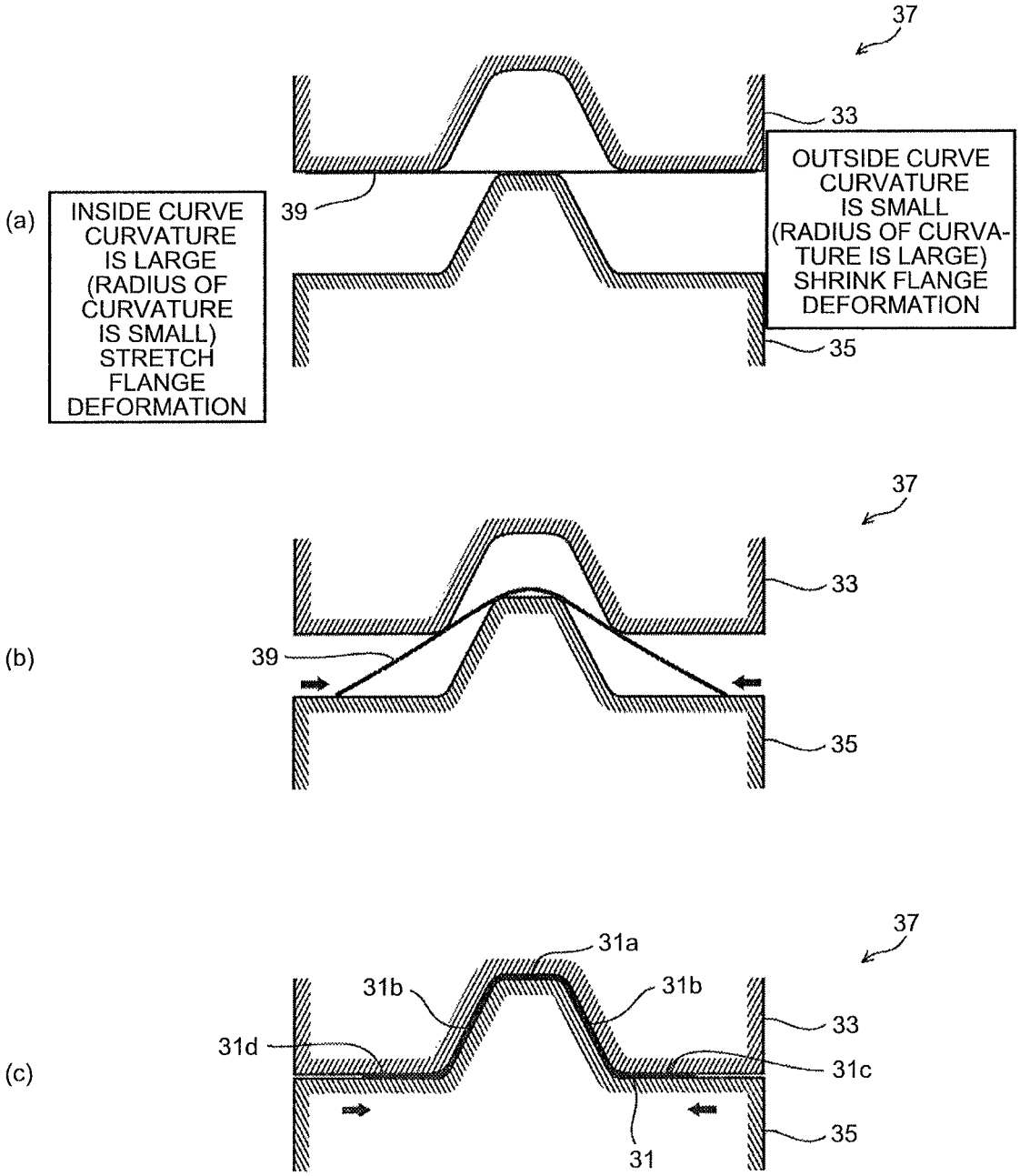
FIG. 21 is an explanatory diagram of the press forming method using the press forming tool illustrated in FIG. 20.
Figure 22:
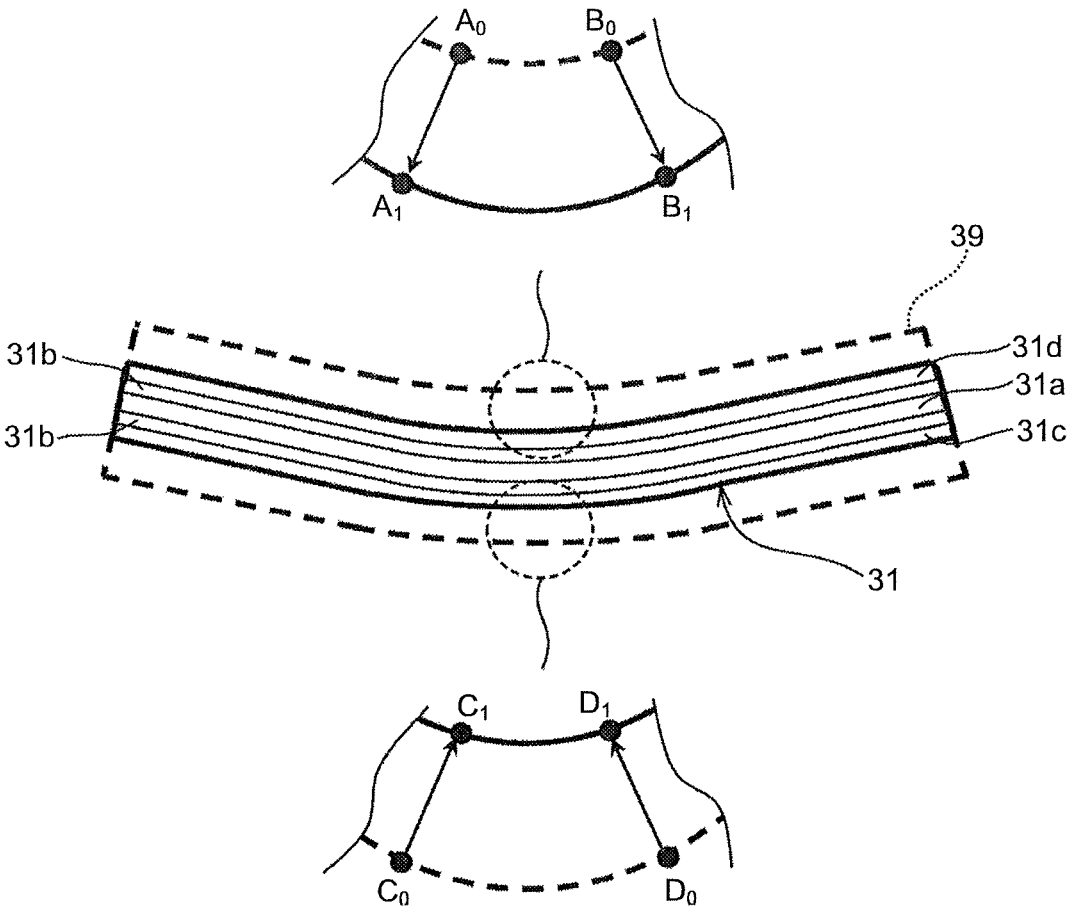
FIG. 22 is an explanatory diagram of a problem of the present invention, and is an explanatory diagram of a mechanism of generating springback in a press formed part formed by the press forming method in the related art.

In crash forming in the related art, forming is performed using a tool of crash forming 37 including a die 33 and a punch 35 as illustrated in a perspective view of FIG. 20 by sandwiching a blank 39 between the die 33 and the punch 35 as illustrated in FIG. 21. FIG. 22 is a diagram illustrating an outline of the blank before and after forming. For the outline corresponding to a flange portion (hereinafter, the inner flange 31*d*) on a side where a curve curvature is large (a side where a radius of curvature is small), a curvature is reduced (the radius of curvature is increased) when the blank flows therein by forming, and a line length is increased ($A_0B_0 \rightarrow A_1B_1$). That is, the inner flange 31*d* is subjected to stretch flange deformation, and tensile stress remains in a longitudinal direction at a bottom dead center of forming.

In contrast, for the flange portion (hereinafter, the outer flange 31*c*) on a side where the curve curvature is small (a side where the radius of curvature is large), the curvature of the outline is increased (the radius of curvature is reduced) when the blank flows therein by forming, and the line length is reduced ($C_0D_0 \rightarrow C_1D_1$). That is, the outer flange 31*c* is subjected to shrink flange deformation, and compressive stress remains in the longitudinal direction at the bottom dead center of forming.

Figure 23:
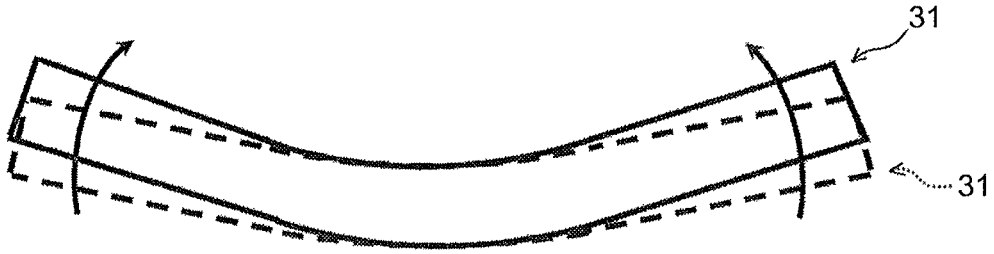
FIG. 23 is an explanatory diagram of a problem of the present invention, and is an explanatory diagram of springback in the press formed part formed by the press forming method in the related art.

The residual stress is elastically recovered at the time of die release, shrink deformation is caused in the inner flange 31*d*, and stretch deformation is caused in the outer flange 31*c*. As illustrated in FIG. 23, this results in springback of the part, which will in turn cause bending deformation of the part such that the curve curvature is increased (the radius of curvature is reduced). In FIG. 23, a dashed line indicates a shape before springback, and a solid line indicates a shape after springback.

As described above, in the press formed part 31 including the flange portion (the outer flange 31*c* and the inner flange 31*d*) curved in the longitudinal direction, the residual stress in the flange portion is released at the time of die release, resulting in springback, which in turn causes bending deformation of the entire press formed part 31. Consequently, it is very important to reduce residual stress in the flange portion of the press formed part 31 to reduce springback.

Accordingly, the inventors of the present invention have conceived, as the method of reducing the residual stress in the flange portion, of forming in which the line length of the flange portion is largely changed as compared with a product shape in the press forming process and the line length of the flange portion is returned to the product shape thereafter. As a specific means of the forming, the inventors of the present invention have conceived of dividing the press forming process into a plurality of processes, and using a press forming tool including a joining portion having a different shape for each press forming tool for each press forming process, the joining portion joining a side wall forming portion and a flange forming portion.

In the press forming method according to an embodiment of the present invention, the press formed part 31 is formed using a press forming tool having a side wall forming portion, a flange forming portion, and a joining portion that joins the flange forming portion to the side wall forming portion, the press formed part 31 illustrated in FIG. 18 having a product shape that has the groove-shaped portion 31*e* extending in the longitudinal direction and has the flange portion (the outer flange 31*c* and the inner flange 31*d*) curved along the longitudinal direction on at least one of a pair of side wall portions 31*b* defining the groove-shaped portion 31*e*. The press forming method includes: a first forming process of forming the flange portion subjected to stretch flange deformation so that the line length in the longitudinal direction is caused to be longer than the line length of the flange portion having the product shape, and forming the flange portion subjected to shrink flange deformation so that the line length in the longitudinal direction is caused to be shorter than the line length of the flange portion having the product shape; and a second forming process in which forming is performed using a press forming tool for making the product shape.

Figure 1:
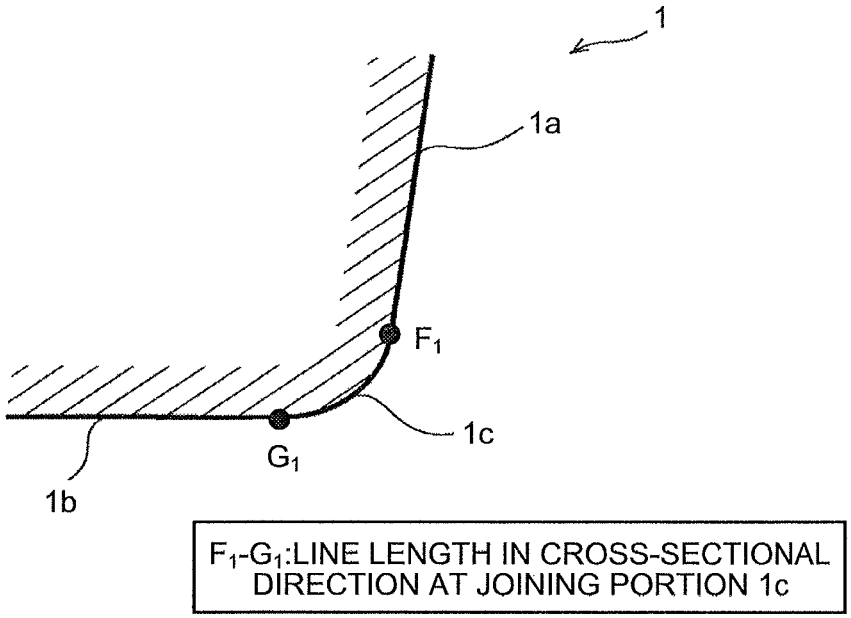
FIG. 1 is a cross-sectional view of segment of a press forming tool used for a press forming method according to an embodiment of the present invention.
Figure 1:
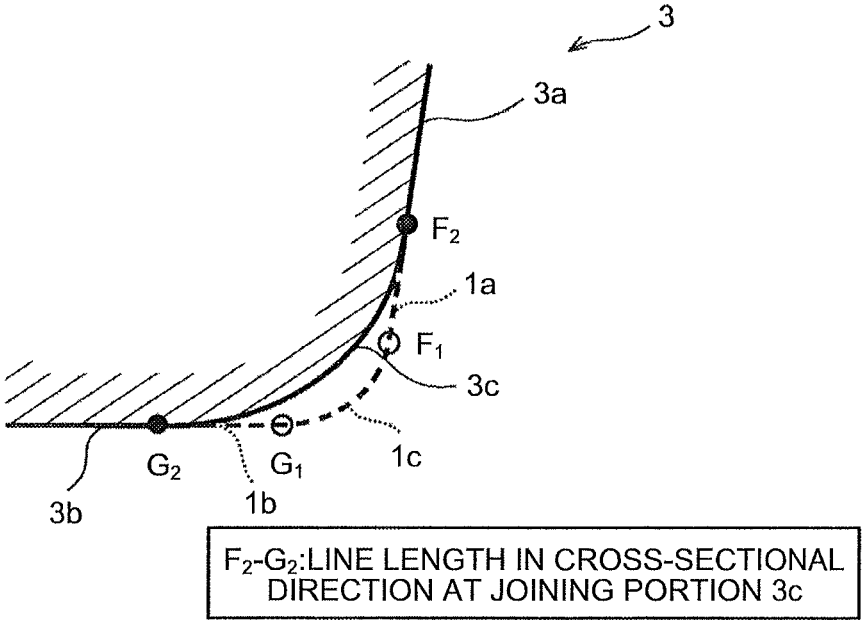

The following describes the shape of the press forming tool for each forming process based on FIG. 1 before describing the forming process. Section (a) in FIG. 1 illustrates a cross section of a die shoulder portion of a first press forming tool 1 for the first forming process, and section (b) in FIG. 1 illustrates a cross section of a die shoulder portion of a second press forming tool 3 for the second forming process. The first press forming tool 1 includes a side wall forming portion 1*a* forming the side wall portion 31*b*, a flange forming portion 1*b* forming the flange portion, and a joining portion 1*c* joining the side wall forming portion 1*a* to the flange forming portion 1*b*. As illustrated in FIG. 1, the die shoulder portion is constituted of segment of the side wall forming portion 1*a*, segment of the flange forming portion 1*b*, and the joining portion 1*c*.

The side wall forming portion 1*a* is a portion that forms a side wall portion of a hat cross-sectional shape, for example, and includes an inclined or vertical flat surface. The flange forming portion 1*b* is a portion that forms the flange portion (the outer flange 31*c* and the inner flange 31*d*) of the hat cross-sectional shape, and includes a flat surface portion. However, the flange forming portion 1*b* is based on the product shape, and is not necessarily a horizontal surface. The joining portion 1*c* is a portion that joins the side wall forming portion la to the flange forming portion 1*b*, which is a portion between a joining point with respect to the side wall forming portion 1*a* and a joining point with respect to the flange forming portion 1*b*. Each of ends $F_1$ and $G_1$ of the joining portion 1*c* is a starting point of a curve. Although the die shoulder portion has been described above, the punch shoulder portion is formed to have a similar shape in the first press forming tool 1.

Similarly to the die shoulder portion of the first press forming tool 1, the die shoulder portion of the second press forming tool 3 includes a side wall forming portion 3*a* forming the side wall portion, a flange forming portion 3*b* forming the flange portion, and a joining portion 3*c* joining the side wall forming portion 3*a* to the flange forming portion 3*b*. As described above regarding the first press forming tool 1, the punch shoulder portion is formed to have a shape similar to that of the die shoulder portion also in the second press forming tool 3. The length of the joining portion is different between the die shoulder portion of the first press forming tool 1 and the die shoulder portion of the second press forming tool 3, which is a characteristic of an embodiment of the present invention. The following describes the characteristic in detail.

A line length ($F_1$–$G_1$) in a cross-sectional direction of the joining portion 1*c* of the first press forming tool 1 is set to be shorter than a line length ($F_2$–$G_2$) in the cross-sectional direction of the joining portion 3*c* of the second press forming tool 3. In other words, a length of a flat part of the side wall forming portion 1*a* of the first press forming tool 1 is longer than a length of a flat part of the side wall forming portion 3*a* of the second press forming tool 3. With such a shape, forming can be performed such that the blank is pushed into the inside of the part using the die shoulder portion in the first forming process with the first press forming tool 1, and the pushed blank is pushed back to the outside of the part in the second forming process. A mechanism for preventing springback with such a configuration will be described in detail in the following description about the forming method.

First Forming Process

Figure 2:
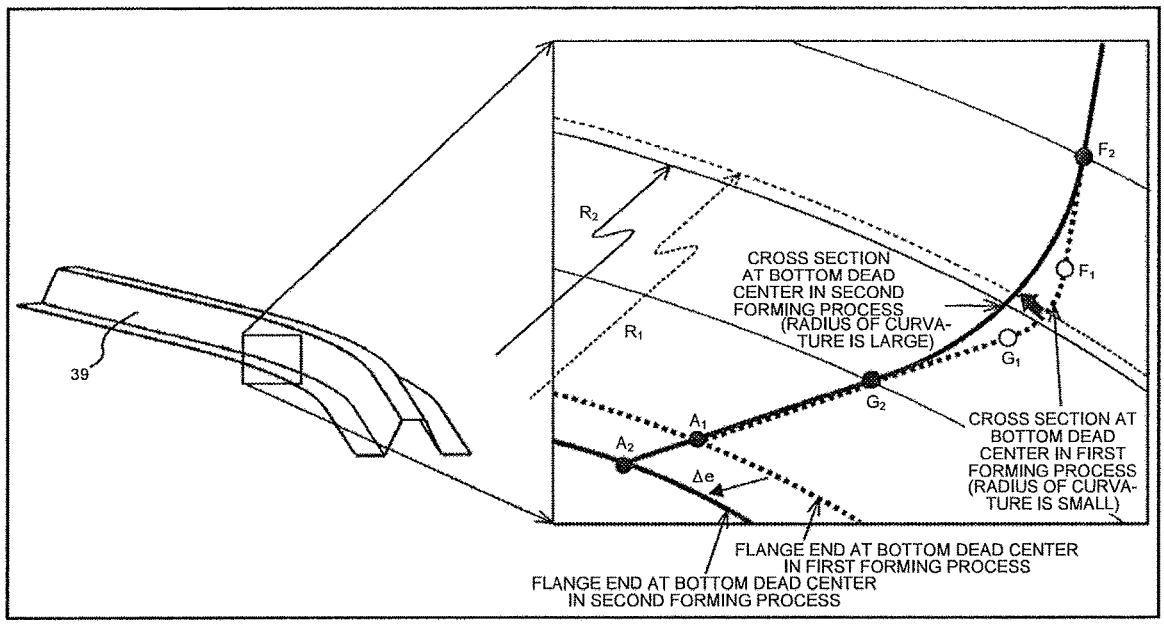
FIG. 2 is an explanatory diagram of the press forming method according to an embodiment of the present invention, and illustrates a behavior of a blank inside a curve in a forming process.
Figure 3:
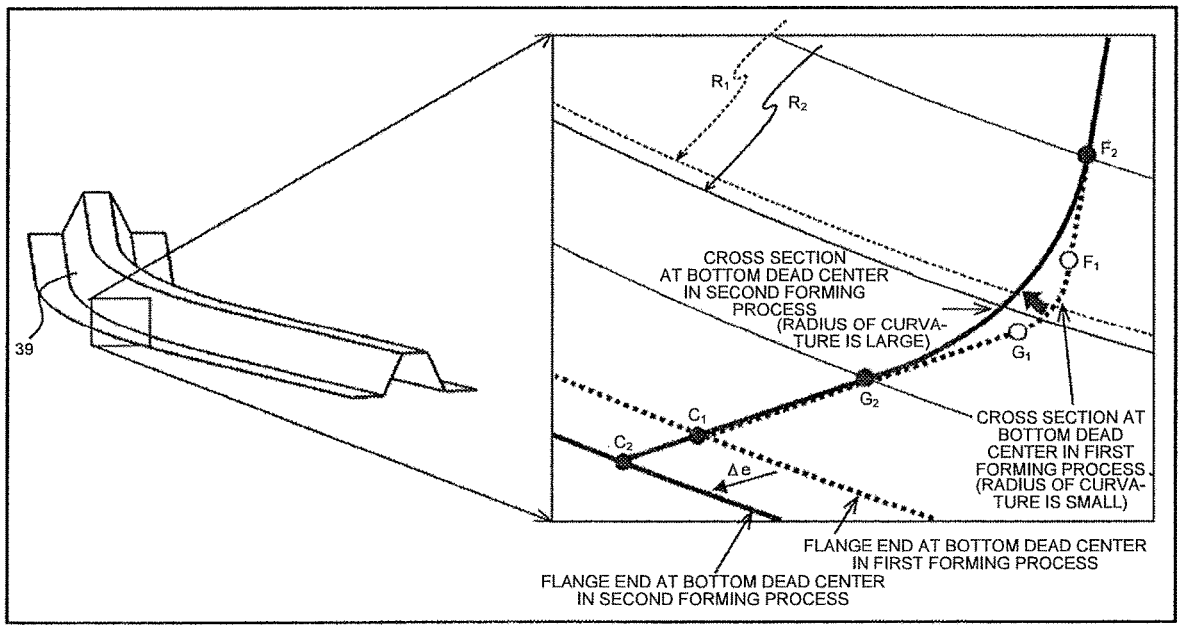
FIG. 3 is an explanatory diagram of the press forming method according to an embodiment of the present invention, and illustrates a behavior of a blank outside a curve in the forming process.

In the first forming process, for example, crash forming as illustrated in FIG. 21 is performed by using the tool of crash forming 37 including the die 33 and the punch 35 illustrated in FIG. 20. In a bottom dead center state in the first forming process, the blank is caused to be in a state represented by a dashed line in enlarged views of FIGS. 2 and 3. FIG. 2 illustrates an enlarged view of the inside of the curve, and FIG. 3 illustrates an enlarged view of the outside of the curve. As represented by the dashed line in FIGS. 2 and 3, at the bottom dead center in the first forming process, positions of flange ends of the blank 39 are $A_1$ and $C_1$.

Second Forming Process

In the second forming process performed by using the second press forming tool 3, the blank is pushed back toward the outside of the part (represented by the thick arrow in FIGS. 2 and 3) because a pushing amount of the second press forming tool 3 toward the inside is smaller than that of the first press forming tool 1. As a result, the position of the flange end of the blank 39 is moved to the outside of the part of the flange portion having small restriction. At the bottom dead center in the second forming process, the blank is caused to be in a state represented by the solid line in the enlarged views of FIGS. 2 and 3, and the positions of the flange ends of the blank 39 are $A_2$ and $C_2$.

As described above, the positions of the flange ends of the blank 39 are moved by Δe from the positions $A_1$ and $C_1$ at the bottom dead center in the first forming process to the respective positions $A_2$ and $C_2$ at the bottom dead center in the second forming process. The following describes a mechanism by which, in a curved part, the flange end is moved to the inside or the outside of the curve based on FIG. 4.

Inside of Curve of Formed Part

Figure 4:
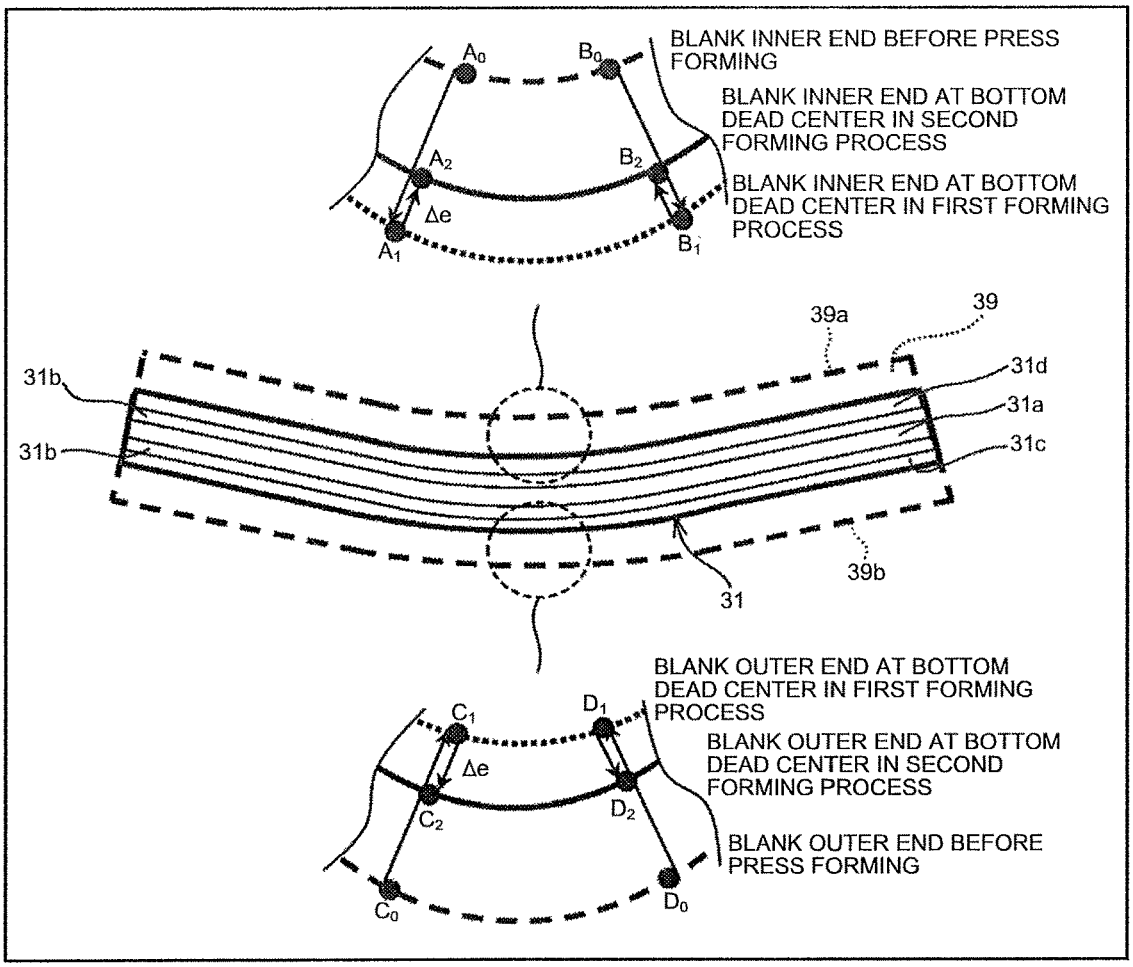
FIG. 4 is an explanatory diagram of a mechanism by which an effect of the press forming method according to an embodiment of the present invention is produced.

At the bottom dead center in the first forming process inside the curve, with reference to an enlarged view of the inside of the curve in a plan view of FIG. 4, $A_0B_0$ at an inner end 39*a* becomes $A_1B_1$ due to entry of the blank 39 from when forming is started to the bottom dead center in the first forming process (first forming process), and the line length of the inner end 39*a* is increased (stretch flange deformation). At the bottom dead center in the second forming process, the blank is formed into the product shape with the second press forming tool 3 illustrated in FIG. 1. With reference to an enlarged view of the inside of the curve in FIG. 4, at the bottom dead center in the second forming process, the inner end 39*a* is moved by Δe toward the inside of the curve, so that the line length of the inner end 39*a* is changed from $A_1B_1$ to $A_2B_2$, that is, the line length is slightly reduced.

Outside of Curve of Formed Part

At the bottom dead center in the first forming process outside the curve, as illustrated in the enlarged view of FIG. 4, $C_0D_0$ at an outer end 39*b* becomes $C_1D_1$ due to entry of the blank 39, and the line length of the outer end 39*b* is reduced (shrink flange deformation).

At the bottom dead center in the second forming process, the blank is formed into the product shape with the second press forming tool 3 illustrated in FIG. 1. With reference to the enlarged view of the outside of the curve in FIG. 4, the outer end 39*b* is moved by Δe toward the outside of the curve, so that the line length of the outer end 39*b* is changed from $C_1D_1$ to $C_2D_2$, that is, the line length is slightly increased.

In this way, the inner flange 31*d* is formed so that the line length is prolonged as compared with the product shape of the press formed part 31 in the first forming process, and the prolonged line length is slightly restored in the second forming process to be the line length of the product shape of the press formed part 31. On the other hand, the outer flange portion 31*c* is formed so that the line length is shortened as compared with the product shape of the press formed part 31 in the first forming process, and the shortened line length is slightly restored in the second forming process to be the line length of the product shape of the press formed part 31. Thus, in the inner flange 31*d* and the outer flange 31*c*, a strain generated in the first forming process is slightly restored in the second forming process, and the residual stress is significantly reduced accordingly.

Figure 5:
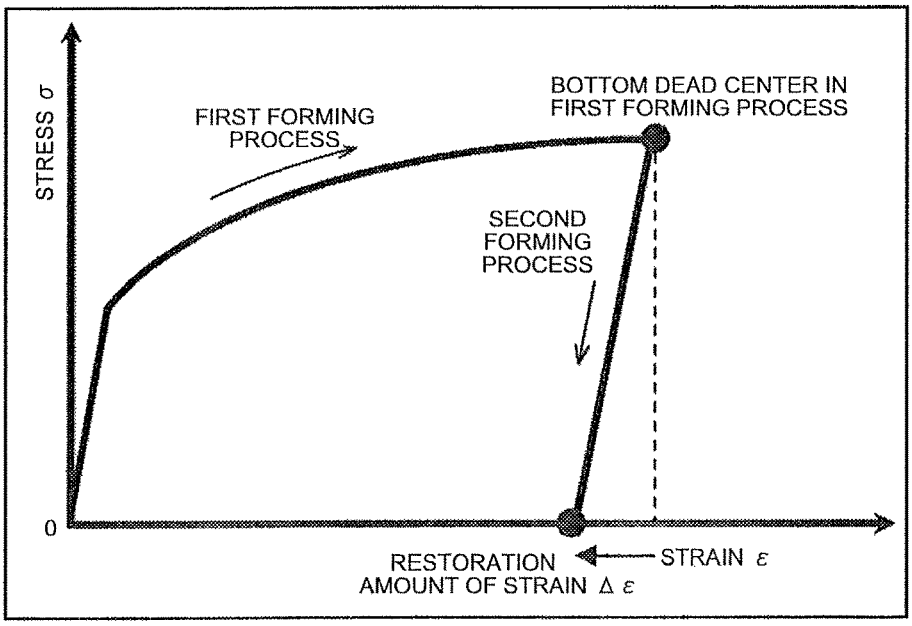
FIG. 5 is an explanatory diagram of a mechanism by which an effect of the press forming method according to an embodiment of the present invention is produced.

Such a configuration will be described below based on FIG. 5. FIG. 5 is a stress-strain diagram in the longitudinal direction after the flange portion is started to be formed. As illustrated in FIG. 5, large residual stress is accumulated in the flange portion at the bottom dead center in the first forming process. However, the residual stress is significantly reduced by slightly restoring the strain in the second forming process from the bottom dead center in the first forming process. As described above, the present invention is made by utilizing a characteristic that the residual stress is largely changed when the strain is slightly restored, that is, the residual stress is sensitively changed in accordance with restoration of the strain.

A restoration amount of the strain is determined based on the movement amount Δe of the flange end between the first forming process and the second forming process, and the movement amount Δe is determined based on the shape of the die shoulder portion of the first press forming tool 1 and the second press forming tool 3, specifically, the shape of the joining portion thereof. When a difference in the line length between the joining portions 1*c* and 3*c* of the first press forming tool 1 and the second press forming tool 3 is large, the movement amount Δe of the flange end is large, and the restoration amount of the strain in the longitudinal direction of the part is also large, which leads to a large effect of reducing the residual stress.

In this way, according to the present embodiment, the restoration amount of the strain can be adjusted only by adjusting the shape of the joining portion having a shape of the press forming tool, and springback can be relieved without greatly changing the shape of the press forming tool.

Figure 6:
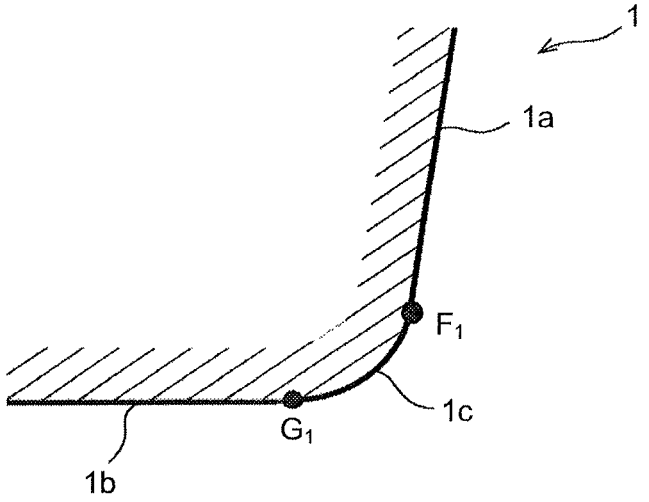
FIG. 6 is a cross-sectional view of segment of the press forming tool according to another aspect, the press forming tool being used for the press forming method according to an embodiment of the present invention.
Figure 6:
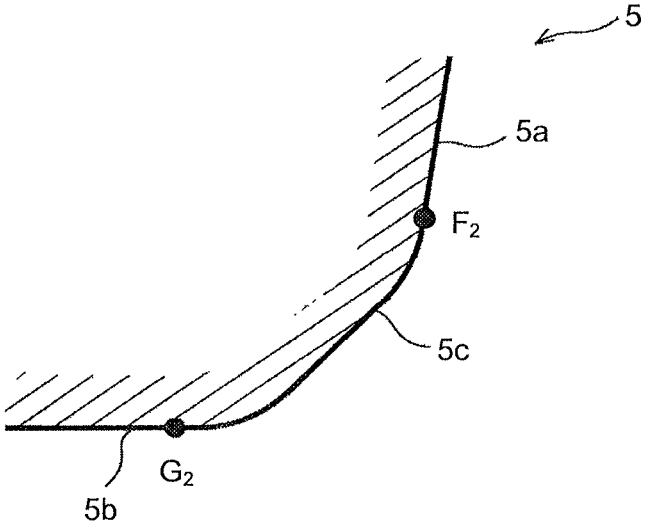

In the above example, the joining portions 1*c* and 3*c* having an arc shape are exemplified for both of the first press forming tool 1 and the second press forming tool 3, but the present invention is not limited thereto. It is sufficient that the length of the joining portion 3*c* in the second press forming tool 3 is longer than the joining portion 1*c* in the first press forming tool 1. For example, as illustrated in FIG. 6, although the joining portion 1*c* of the first press forming tool 1 has an arc shape, a joining portion 5*c* of a second press forming tool 5 has a chamfered shape produced by chamfering the die shoulder portion of the first press forming tool 1. In FIG. 6, the same portion as that in FIG. 1 is denoted by the same reference numeral.

Figure 7:
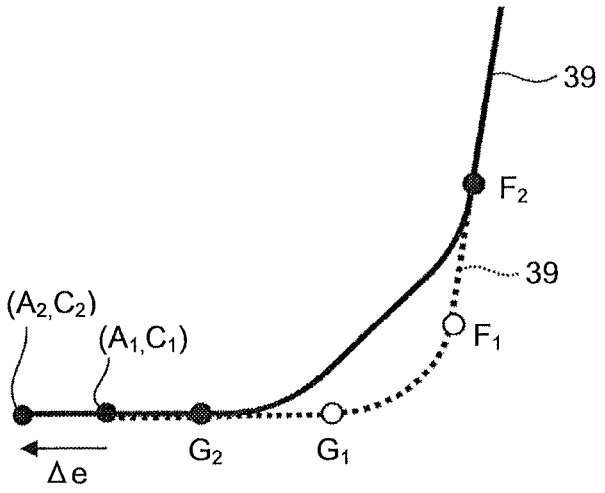
FIG. 7 is an explanatory diagram for explaining the behavior of the blank in the forming process in a case of using the press forming tool illustrated in FIG. 6.

When the blank 39 is formed with the second press forming tool 5 in section (b) in FIG. 6 after being formed with the first press forming tool 1 in section (a) in FIG. 6, the blank 39 is caused to be in a state represented by the solid line from a state represented by the dashed line as illustrated in FIG. 7, the flange end is moved by Δe toward the outside of the part, and springback can be reduced by the same mechanism as that described above in FIGS. 4 and 5.

Figure 8:
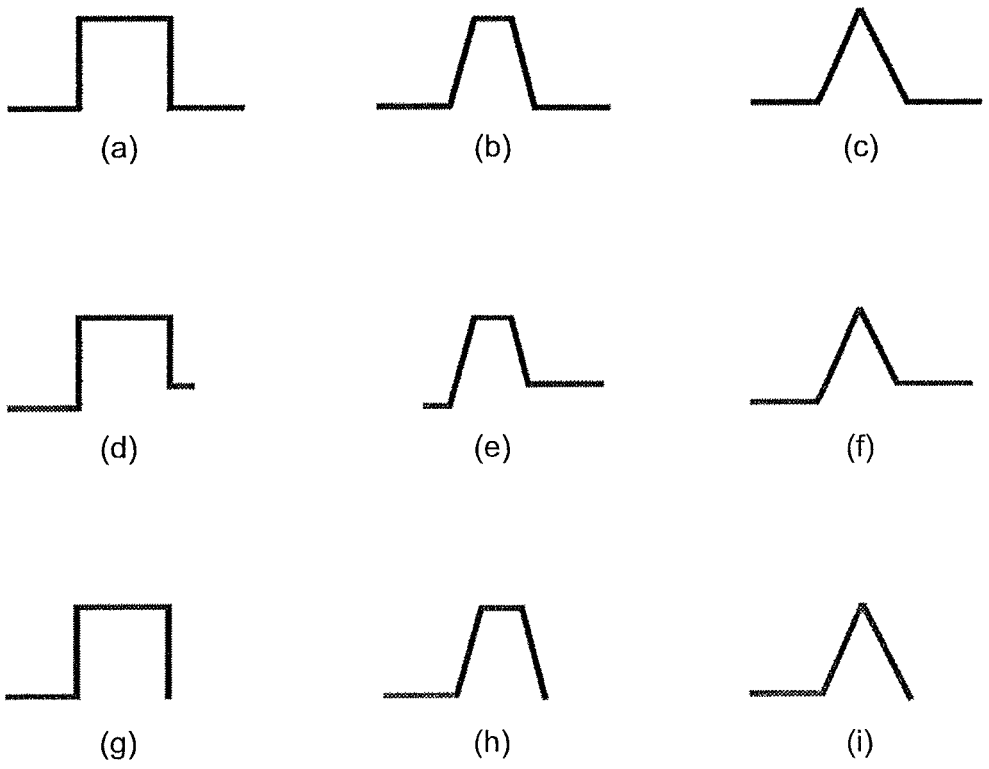
FIG. 8 is an explanatory diagram for explaining a cross-sectional shape of a press formed part to which the present invention can be applied.

The product shape of the press formed part for providing the effect of the present invention may be a shape having a flange portion curved along the longitudinal direction and having the flange portion on at least one of a pair of side wall portions defining a groove-shaped portion. FIG. 8 illustrates a plurality of examples of cross sections of the product shape of the press formed part to which the present invention can be applied, and the following describes each of the cross sections.

Sections (a) to (f) in FIG. 8 include curved flange portions on both of the inside and the outside. The side wall portion may be vertical as illustrated in sections (a) and (d) in FIG. 8, or may be inclined as illustrated in sections (b), (c), (e) and (f) in FIG. 8. As illustrated in sections (c) and (f) in FIG. 8, a shape including no punch bottom portion may be employed, the punch bottom portion being made by connecting both side wall portions at the top. As illustrated in sections (g) to (i) in FIG. 8, the curved flange portion may be provided on any one of the side wall portions. The widths of the right and left flange portions may be different from each other.

Figure 9:
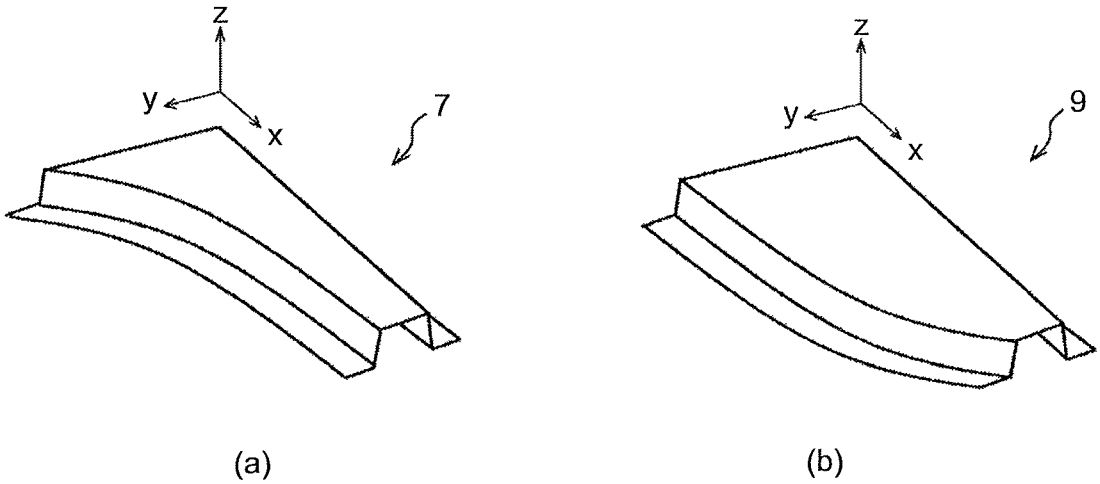
FIG. 9 is a diagram illustrating an example of a product shape to which the present invention can be applied.

With reference to a press formed part 7 in section (a) in FIG. 9 and a press formed part 9 in section (b) in FIG. 9, the curved flange portion may be provided on any one of the inside and the outside, and a non-curved flange portion may be provided on the other one thereof. The entire product shape of the press formed part is not necessarily curved.

Figure 10:
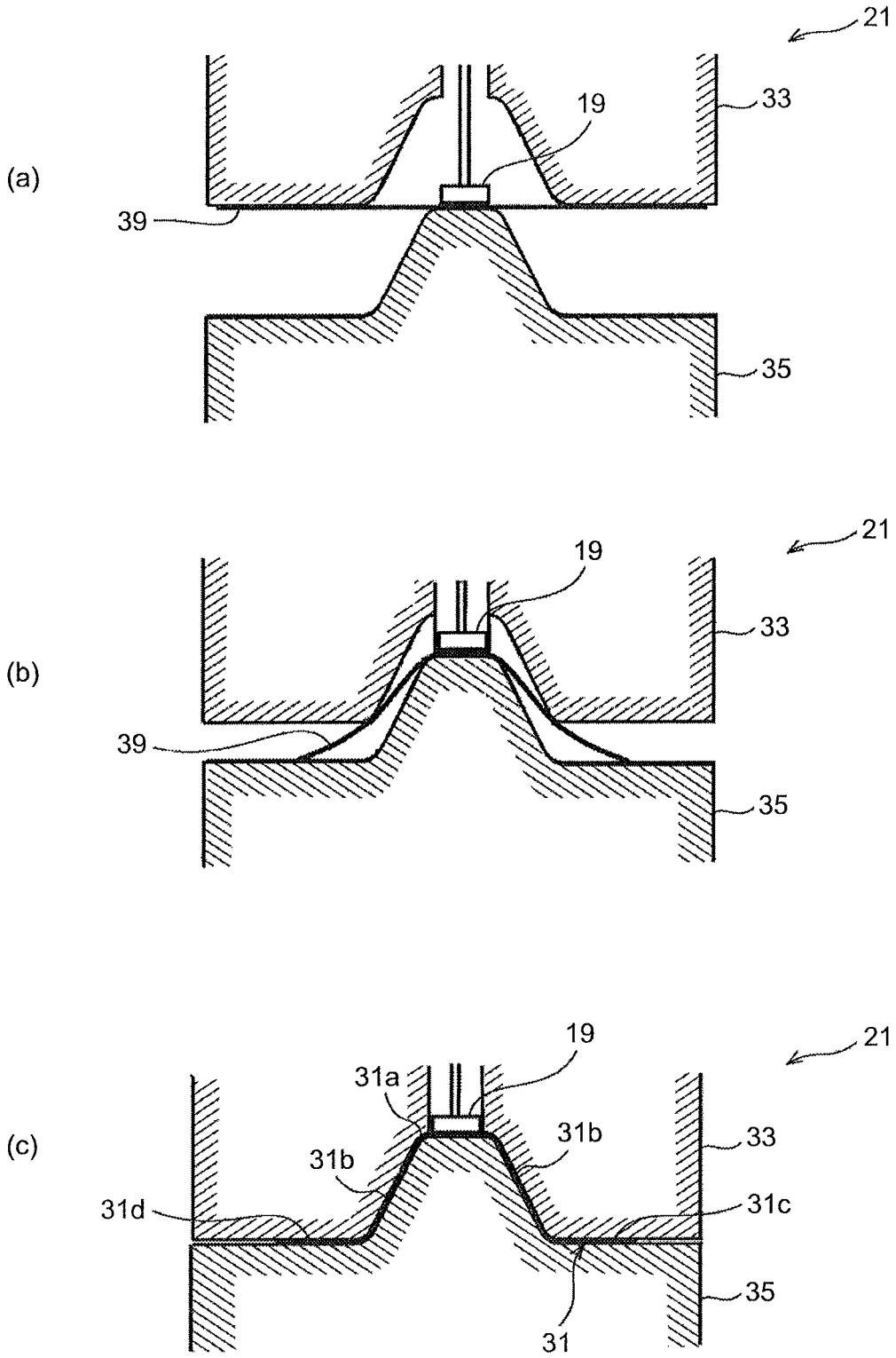
FIG. 10 is an explanatory diagram of another aspect of the press forming method to which the present invention can be applied.
Figure 11:
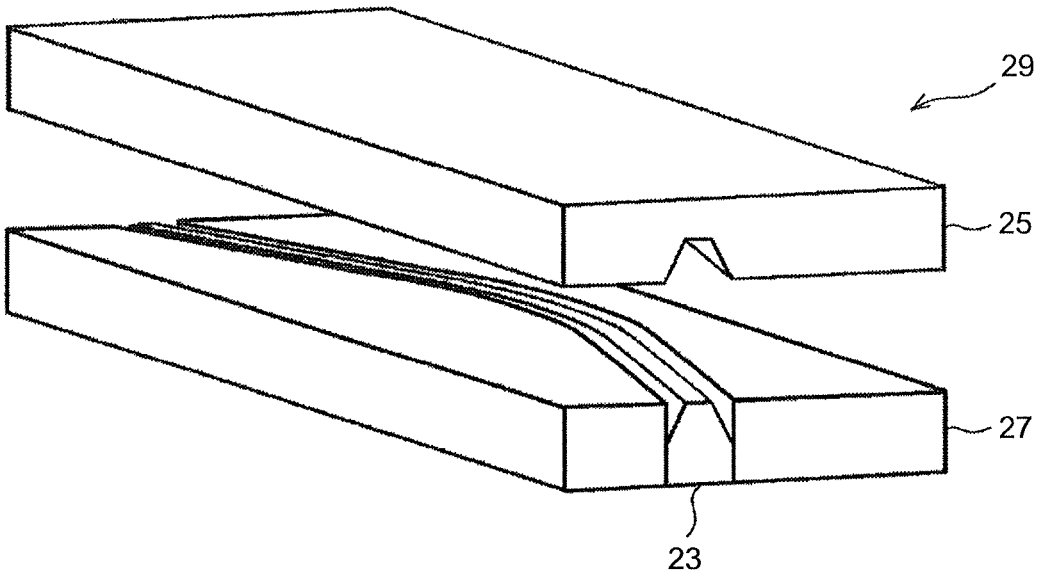
FIG. 11 is an explanatory diagram of the press forming tool used for another aspect of the press forming method to which the present invention can be applied.
Figure 12:
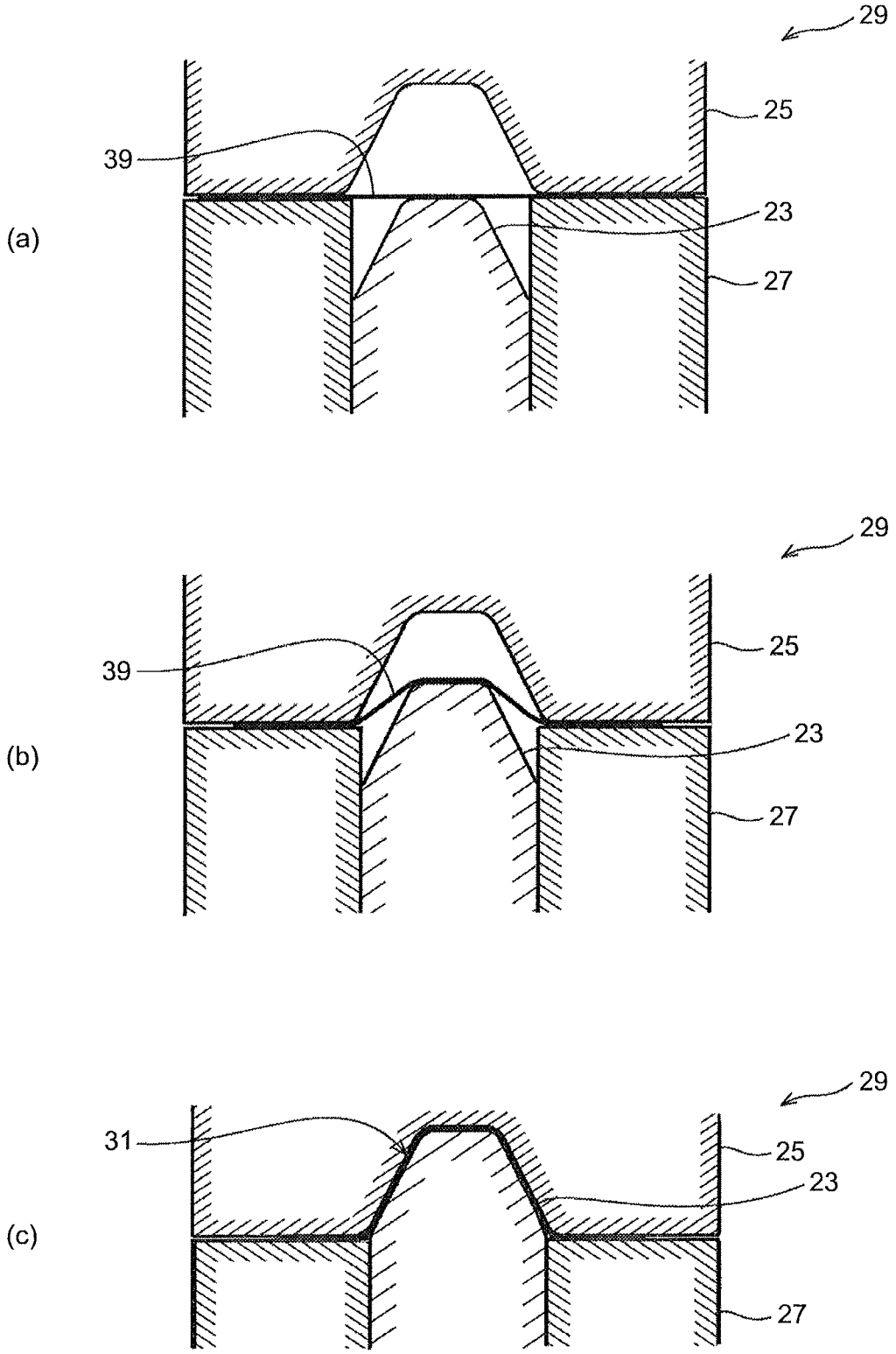
FIG. 12 is an explanatory diagram of the press forming method using the press forming tool illustrated in FIG. 11.

The present invention can also be applied to crash forming with a tool of crash forming 21 with a pad using a pad 19 paired with the punch bottom portion as illustrated in FIG. 10. In FIG. 10, a portion that is the same as or corresponding to that in FIG. 21 is denoted by the same reference numeral. In the first forming process, a tool of draw forming 29 including a punch 23, a die 25, and a blank holder 27 illustrated in FIG. 11 can be applied to draw forming including a forming process as illustrated in FIG. 12.

When the curved flange portion is provided to both side wall portions, the effect of the present invention can be exhibited by applying the present invention to only one of the flange portions. The present invention is different from the method disclosed in Patent Literature 1 for preventing springback on a (two-dimensional) cross section such as angle variation of a bending portion of a hat-shaped cross section or curl of a side wall portion. The present invention prevents curl or torsion from being three-dimensionally generated in the entire formed part, so that the effect for the entire press formed part can be provided by applying the present invention to one of the flange portions. This configuration is demonstrated in examples described later.

EXAMPLE 1

Figure 13:
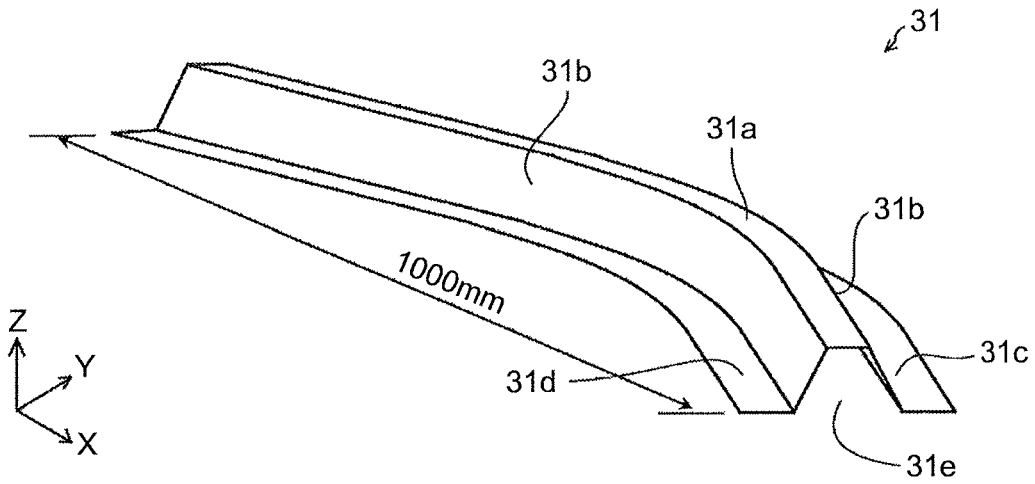
FIG. 13 is a perspective view for explaining a product shape of a press formed part according to an example of the present invention.
Figure 14:
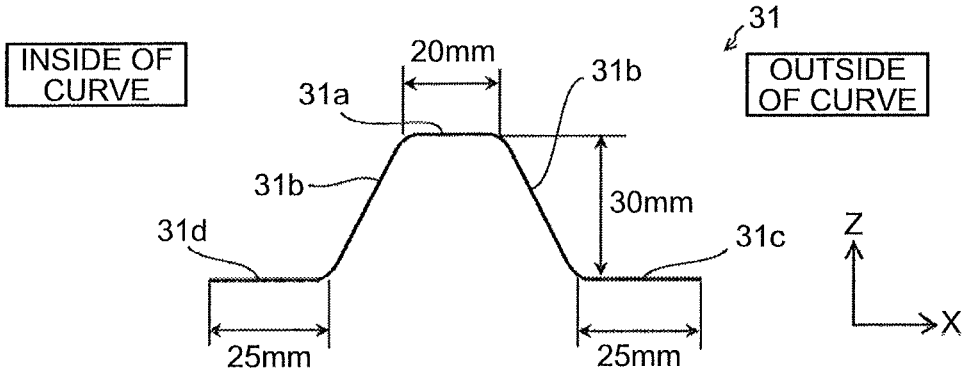
FIG. 14 is a cross-sectional view of the press formed part illustrated in FIG. 13.

The following describes a specific experiment that has been performed for a working effect of the press forming method according to the present invention. The following summarizes an experiment method. The experiment method is such that forming is performed under a plurality of press forming conditions using a press forming device to compare amounts of springback of the formed press formed parts with each other. The press formed part 31 as a forming target has a shape having a hat cross section and curved along the longitudinal direction as illustrated in FIGS. 13 and 14. The length of the press formed part is 1000 mm, the height of the cross section is 30 mm, the width of the punch bottom portion is 20 mm, the width of each of the inner and outer flanges is 25 mm, a curving radius of curvature at the center of the width of the part is 500 mm, and a bending radius of the die shoulder portion is 10 mm. For a steel sheet, a 980 MPa grade steel sheet having a thickness of 1.2 mm was used. A 10000 kN hydraulic press machine was used for a forming test.

Figure 15:
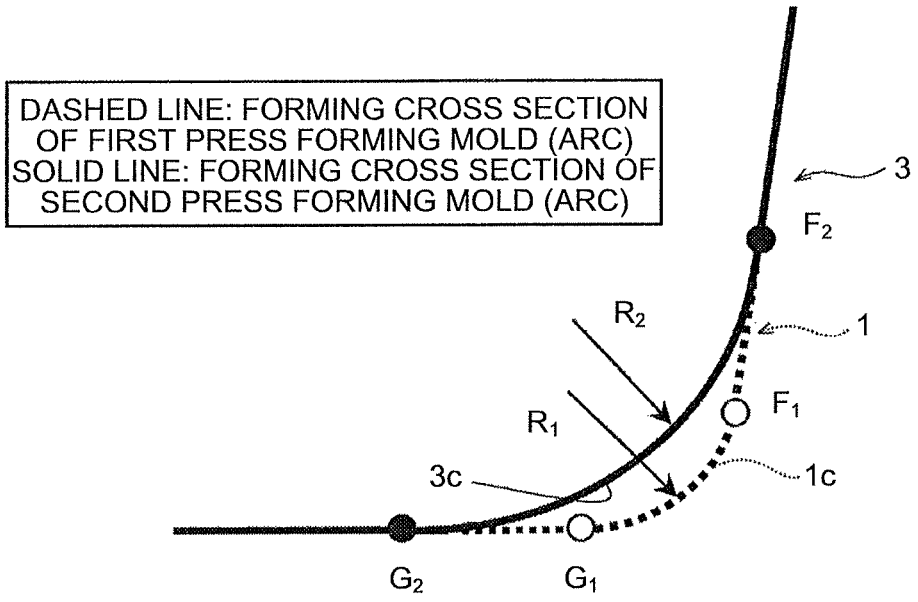
FIG. 15 is an explanatory diagram of a press forming tool used in Examples 1 to 3 of the present invention.

The tool of crash forming is used in this example, and the present invention can be applied to both of the die shoulder portion (inner die shoulder portion) that is in contact with the inner flange and the die shoulder portion (outer die shoulder portion) that is in contact with the outer flange. That is, as illustrated in FIG. 15, the first press forming tool 1 was used in the first forming process, the first press forming tool 1 having a distance $L_1$ ($F_1$–$G_1$) of the joining portion 1*c* of 2.1 mm, 4.2 mm, 6.3 mm, and 8.4 mm and a die shoulder radius $R_1$ of 2 mm, 4 mm, 6 mm, and 8 mm. The second press forming tool 3 was used in the second forming process, the second press forming tool 3 having the distance $L_2$ ($F_2$–$G_2$) of the joining portion 3*c* of 10.5 mm and the die shoulder radius $R_2$ of 10 mm. A part formed to have a final shape through one time of press forming using the second press forming tool 3 was assumed to be a comparative example. Crash forming with a pad illustrated in FIG. 10 was also performed. A pad pressure was set to be 500 kN.

Figure 16:
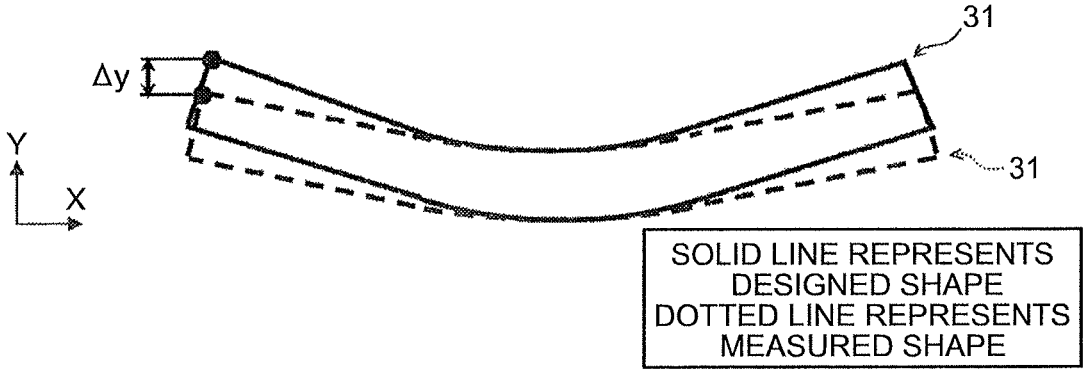
FIG. 16 is an explanatory diagram of a method of evaluating an amount of springback according to an example of the present invention.

The shape of the press formed part after press forming was measured through three-dimensional shape measurement. Subsequently, after alignment was performed on measurement data so that a curved part at the center of the longitudinal direction was aligned with a designed shape on CAD software, calculated was a Y-coordinate difference Δy between measured shape data and designed shape data at an end of the part illustrated in FIG. 16. This value was used as an indicator for bending deformation due to springback. If Δy is a positive value, it means that the press formed part is bending-deformed in a direction in which the curving radius of curvature thereof is reduced. If Δy is a negative value, it means that the press formed part is bending-deformed in a direction in which the curving radius of curvature is increased. Table 1 indicates Δy of the press formed part formed under each forming condition.

TABLE 1

| | First forming process $L_1$ [mm] | Second forming process $L_2$ [mm] | Pad (Present/ Absent) | Bending amount Δy [mm] |
|---|---|---|---|---|
| Comparative example 1 | — | 10.5 | Absent | 6.3 |
| Example 1 of present invention | 8.4 | | Absent | 4.8 |
| Example 2 of present invention | 6.3 | | Absent | 2.6 |
| Example 3 of present invention | 4.2 | | Absent | 0.3 |
| Example 4 of present invention | 2.1 | | Absent | −2.0 |
| Comparative example 2 | — | | Present | 6.4 |
| Example 5 of present invention | 4.2 | | Present | 0.5 |

A bending amount Δy tends to be smaller as the distance $L_1$ of the joining portion 1*c* of the first press forming tool 1 is reduced, and reversal of positive and negative was caused under a forming condition without a pad where $L_1$=2.1 mm. A forming condition having the smallest bending amount Δy was Δy=0.3 mm when $L_1$=4.2 mm without a pad, and springback was significantly reduced as compared with the comparative example. Also in forming (Example 5 of the present invention) using a pad, the bending amount Δy was 0.5 mm, which was significantly reduced as compared with 6.3 mm in Comparative example 1, and the effect of the present invention was confirmed.

EXAMPLE 2

In Example 1, the present invention was applied to both of the die shoulder portion inside the curve and the die shoulder portion outside the curve. However, in Example 2, the present invention is applied to any one of the die shoulder portions to check the effect of reducing springback. The shape of the press formed part, the steel sheet, and a press machine are the same as those in Example 1. A tool of crash forming was used in a forming test of the present invention. The first forming process used the first press forming tool 1 having the distance $L_1$ ($F_1$–$G_1$) of the inner or outer joining portion 1*c* of the first press forming tool 1 of 2.1 mm, 4.2 mm, 6.3 mm, and 8.4 mm. The second forming process used the second press forming tool 3 having the distance $L_2$ ($F_2$-$G_2$) of the inner and outer joining portions of 10.5 mm. Similarly to Example 1, an evaluation indicator of springback is the bending amount Δy. Table 2 indicates Δy of the press formed part formed under each forming condition.

TABLE 2

| | Die shoulder to which present invention is applied | First forming process $L_1$ [mm] | Second forming process $L_2$ [mm] | Bending amount Δy [mm] |
|---|---|---|---|---|
| Comparative example 3 | — | — | 10.5 | 6.3 |
| Example 6 of present invention | Inside | 8.4 | | 5.9 |
| Example 7 of present invention | | 6.3 | | 4.5 |
| Example 8 of present invention | | 4.2 | | 2.8 |
| Example 9 of present invention | | 2.1 | | 0.9 |
| Example 10 of present invention | Outside | 8.4 | | 6.0 |
| Example 12 of present invention | | 6.3 | | 4.7 |
| Example 13 of present invention | | 4.2 | | 3.1 |
| Example 14 of present invention | | 2.1 | | 1.1 |

In both of the inner die shoulder portion and the outer die shoulder portion, the bending amount Δy tends to be smaller as the distance $L_1$ of the joining portion 1*c* of the first press forming tool 1 is reduced. At the inner die shoulder portion, Δy=0.9 mm was satisfied when the distance $L_1$ of the joining portion 1*c*=2.1 mm was satisfied, that is, the bending amount Δy became the smallest value. At the outer die shoulder portion, Δy=1.1 mm was satisfied when the distance $L_1$ of the joining portion 1*c*=2.1 mm was satisfied, that is, the bending amount became the smallest value. In both cases, springback was significantly reduced as compared with the bending amount of 6.3 mm in the comparative example.

EXAMPLE 3

In Example 1 and Example 2, the first forming process was performed by crash forming. In Example 3, a tool of draw forming illustrated in FIG. 11 and FIG. 12 was used for the first forming process, and the present invention was applied to both of the inner die shoulder portion and the outer die shoulder portion. The second forming process was performed by crash forming. The shape of the press formed part, the steel sheet, and a press forming machine are the same as those in Example 1 and Example 2. The first forming process used the tool of draw forming 29 (refer to FIG. 11) having the distance $L_1$ ($F_1$–$G_1$) of the joining portion 1*c* of 2.1 mm, 4.2 mm, 6.3 mm, and 8.4 mm. The second forming process used the tool of crash forming 37 (refer to FIG. 20) having the distance $L_2$ ($F_2$–$G_2$) of the joining portion 3*c* of 10.5 mm. Similarly to Example 1 and Example 2, the evaluation indicator for springback is the bending amount Δy. Table 3 indicates Δy of the press formed part formed under each forming condition.

TABLE 3

| | First forming process $L_1$ [mm] | Second forming process $L_2$ [mm] | Pad (Present/ Absent) | Bending amount Δy [mm] |
|---|---|---|---|---|
| Comparative example 4 | — | 10.5 | Absent | 4.2 |
| Example 15 of present invention | 8.4 | | Absent | 3.9 |
| Example 16 of present invention | 6.3 | | Absent | 1.9 |
| Example 17 of present invention | 4.2 | | Absent | −0.3 |
| Example 18 of present invention | 2.1 | | Absent | −2.2 |
| Comparative example 5 | — | | Present | 4.4 |
| Example 19 of present invention | 4.2 | | Present | 0.5 |

TABLE 3-continued

| | First forming process $L_1$ [mm] | Second forming process $L_2$ [mm] | Pad (Present/ Absent) | Bending amount Δy [mm] |
|---|---|---|---|---|

The bending amount Δy tends to be smaller as the distance $L_1$ of the joining portion 1*c* of the first press forming tool 1 is reduced, and reversal of positive and negative was caused under a forming condition without a pad where $L_1$=4.2 mm. The forming condition having the smallest bending amount. Δy was $L_1$=4.2 mm without a pad, and the bending amount Δy was −0.3 mm in this case. Accordingly, springback was significantly reduced as compared with 4.2 mm in Comparative example 4. In a case of press forming using a pad (Example 19 of the present invention), the bending amount Δy was 0.5 mm, which was significantly reduced as compared with 4.2 mm in Comparative example 4, and the effect of the present invention was confirmed.

EXAMPLE 4

Figure 17:
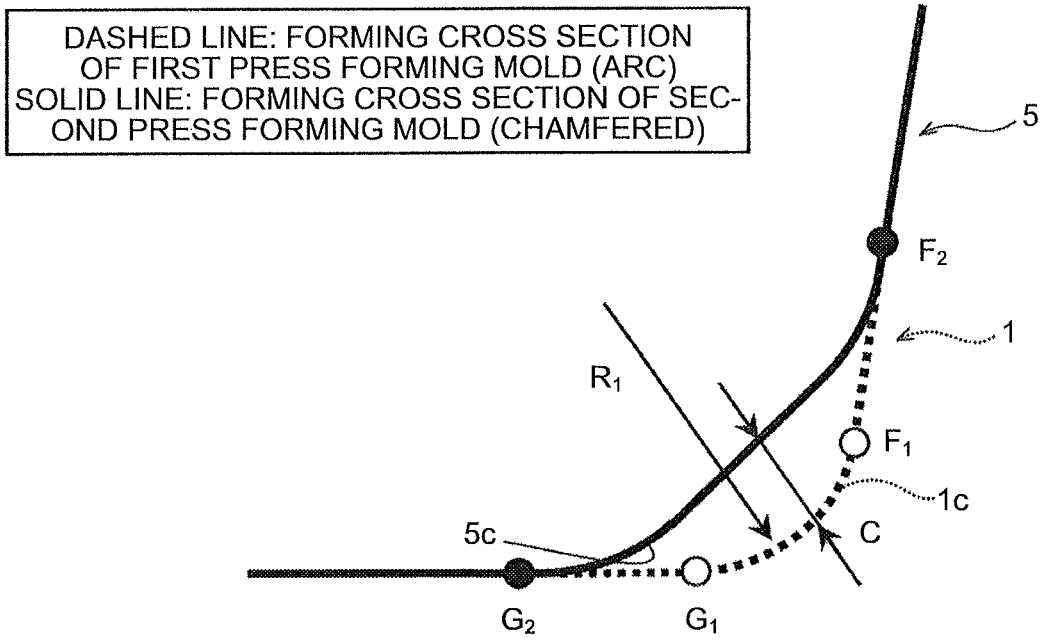
FIG. 17 is an explanatory diagram of a press forming tool used in Example 4 of the present invention.

Example 1 to Example 3 used the second press forming tool 3 the die shoulder portion of which has an arc shape in the second forming process. Example 4 used the second press forming tool 5 the die shoulder portion of which has a chamfered shape. Crash forming was performed with the steel sheet and the press machine that are the same as those in Example 1. As illustrated in FIG. 17, the first forming process used the first press forming tool 1 having the distance $L_1$ ($F_1$−$G_1$) of the joining portion 1*c* of 4.2 mm. The second forming process used the second press forming tool 5 having the distance $L_2$ ($F_2$−$G_2$) of the joining portion 5*c* of 5.3 mm, 7.1 mm, 8.8 mm, and 10.5 mm, and a chamfering amount C of 0.5 mm, 1.0 mm, 1.5 mm, and 2.0 mm. The evaluation indicator for springback is the bending amount Δy similarly to the above examples. Table 4 indicates Δy of the press formed part formed under each forming condition.

TABLE 4

| | First forming process $L_1$ [mm] | Second forming process $L_2$ [mm] | Pad (Present/ Absent) | Bending amount Δy [mm] |
|---|---|---|---|---|
| Comparative example 6 | 4.2 | — | Absent | 7.7 |
| Example 20 of present invention | | 5.3 | Absent | 5.5 |
| Example 21 of present invention | | 7.1 | Absent | 3.2 |
| Example 22 of present invention | | 8.8 | Absent | 0.9 |
| Example 23 of present invention | | 10.5 | Absent | −1.2 |
| Comparative example 7 | | — | Present | 7.7 |
| Example 24 of present invention | | 8.8 | Present | 1.1 |

The bending amount Δy tends to be smaller as the distance $L_2$ of the joining portion 5*c* of the second press forming tool 5 is increased, and reversal of positive and negative was caused under a forming condition without a pad where $L_2$=10.5 mm and C=2.0 mm. The forming condition having the smallest bending amount Δy was $L_2$=8.8 mm without a pad, and the bending amount Δy was 0.9 mm in this case. Accordingly, springback was significantly reduced as compared with the bending amount of 7.7 mm in Comparative example 6. In a case of forming using a pad (Example 24 of the present invention), the bending amount Δy is 1.1 mm, which is significantly reduced as compared with 7.7 mm in Comparative example 6, and the effect of the present invention was confirmed.

The present invention can provide a press forming method and a press forming tool for reducing three-dimensional springback generated in the entire part such as torsion or bending.

REFERENCE SIGNS LIST

1 First press forming tool
1*a* Side wall forming portion
1*b* Flange forming portion
1*c* Joining portion
3 Second press forming tool
3*a* Side wall forming portion
3*b* Flange forming portion
3*c* Joining portion
5 Second press forming tool
5*a* Side wall forming portion
5*b* Flange forming portion
5*c* Joining portion
7 and 9 Press formed part
19 Pad
21 Tool of crash forming with pad
23 Punch
25 Die
27 Blank holder
29 Tool of draw forming
31 Press formed part
31*a* Punch bottom portion
31*b* Side wall portion
31*c* Outer flange
31*d* Inner flange
31*e* Groove-shaped portion
33 Die
35 Punch
37 Tool of crash forming
39 Blank
39*a* Inner end
39*b* Outer end

The invention claimed is:

1. A press forming method for forming a press formed part having a product shape that has a groove-shaped portion extending in a longitudinal direction and includes a flange portion curved along the longitudinal direction on at least one of a pair of side wall portions defining the groove-shaped portion, using a first press forming tool and a second press forming tool each including a side wall forming portion, a flange forming portion, and a joining portion that joins the flange forming portion to the side wall forming portion, the press forming method comprising:

a first forming process of forming the press formed part in an intermediate shape by using the first press forming tool having a line length $L_1$ which is a line length in the cross-sectional direction of the joining portion contacting with a flange portion of the intermediate shape which is subjected to stretch flange deformation or a flange portion of the intermediate shape which is subjected to shrink flange deformation, where the line length $L_1$ is shorter than a line length $L_2$, where the line length $L_2$ is a line length in a cross-sectional direction of the joining portion of the second press forming tool for making the product shape, in order to make a line length of the flange portion of the intermediate shape which is subjected to the stretch flange deformation in a longitudinal direction longer than a line length of the flange portion of the product shape or to make a line length of the flange portion of the intermediate shape which is subjected to the shrink flange deformation in the longitudinal direction shorter than the line length of the flange portion of the product shape; and a second forming process of forming the press formed part from the intermediate shape into the product shape by crash forming by using the second press forming tool in which the line length in the cross-sectional direction of the joining portion is $L_2$.

2. The press forming method according to claim 1, wherein the first forming process and the second forming process are applied to one of the pair of side wall portions.

3. The press forming method according to claim 1, wherein the first forming process and the second forming process are applied to both of the pair of side wall portions.

4. The press forming method according to claim 1, further comprising forming punch bottom portion of the press formed part by performing the first forming process and the second forming process with a portion of the press formed part corresponding to the punch bottom portion pressed with a pad.

5. The press forming method according to claim 1, wherein the joining portions of the first press forming tool and the second press forming tool have an arc cross-sectional shape.

6. The press forming method according to claim 1, wherein the joining portion of the first press forming tool has an arc cross-sectional shape, and the joining portion of the second press forming tool has a chamfered cross-sectional shape produced by chamfering an arc shape.

7. A press forming tool used for a press forming method for forming a press formed part having a product shape that has a groove-shaped portion extending in a longitudinal direction and includes a flange portion that is curved along the longitudinal direction on at least one of a pair of side wall portions defining the groove-shaped portion and subjected to stretch flange deformation and/or shrink flange deformation, through a first forming process and a second forming process, the press forming tool comprising:

a first press forming tool for the first forming process and a second press forming tool for the second forming process, wherein the first press forming tool and the second press forming tool each include a side wall forming portion, a flange forming portion, and a joining portion that joins the flange forming portion to the side wall forming portion, and a line length in a cross-sectional direction of the joining portion of the first press forming tool is set to be shorter than a line length in a cross-sectional direction of the joining portion of the second press forming tool, the joining portion of the first press forming tool being in contact with a flange portion subjected to stretch flange deformation or a flange portion subjected to shrink flange deformation in the first press forming tool.

8. The press forming tool according to claim 7, wherein the joining portions of the first press forming tool and the second press forming tool have an arc cross-sectional shape.

9. The press forming tool according to claim 7, wherein the joining portion of the first press forming tool has an arc cross-sectional shape, and the joining portion of the second press forming tool has a chamfered cross-sectional shape produced by chamfering an arc shape.

* * * * *